US009546024B2

(12) United States Patent
Wu

(10) Patent No.: US 9,546,024 B2
(45) Date of Patent: Jan. 17, 2017

(54) SEALING CAP

(71) Applicant: Tzeng Shyng Industries Corp., Tainan (TW)

(72) Inventor: Shih-Wei Wu, Taipei (TW)

(73) Assignee: TZENG SHYNG INDUSTRIES CORP., Tainan (TW)

( * ) Notice: Subject to any disclaimer, the term of this patent is extended or adjusted under 35 U.S.C. 154(b) by 0 days.

(21) Appl. No.: 14/792,440

(22) Filed: Jul. 6, 2015

(65) Prior Publication Data

US 2016/0280427 A1 Sep. 29, 2016

(30) Foreign Application Priority Data

Mar. 27, 2015 (TW) ..... 104204690 U

(51) Int. Cl.
*B65D 41/04* (2006.01)
*B65D 43/02* (2006.01)
*B65D 51/18* (2006.01)

(52) U.S. Cl.
CPC ..... *B65D 41/0442* (2013.01); *B65D 41/0485* (2013.01); *B65D 43/02* (2013.01); *B65D 51/18* (2013.01); *B65D 2251/009* (2013.01); *B65D 2251/0015* (2013.01); *B65D 2251/0028* (2013.01); *B65D 2251/0081* (2013.01)

(58) Field of Classification Search
CPC ..... B65D 41/04; B65D 41/62; B65D 43/02; B65D 43/022; B65D 51/18; B65D 2543/00101;B65D 2543/00231; B65D 2543/0025; B65D 2543/00296; B65D 2543/00509; B65D 2543/00546; B65D 2543/00935; B65D 2543/0099
See application file for complete search history.

(56) References Cited

U.S. PATENT DOCUMENTS 4,643,330 A * 2/1987 Kennedy ..... B65D 41/04 215/329
6,659,302 B2 * 12/2003 Lin ..... A47G 19/2272 220/254.8
2012/0305558 A1 * 12/2012 Steininger ..... B65D 43/022 220/235
2013/0037540 A1 * 2/2013 Sze ..... B65D 43/022 220/237

* cited by examiner

*Primary Examiner* — Andrew Perreault
(74) *Attorney, Agent, or Firm* — DLA Piper LLP (US)

(57) ABSTRACT

A sealing cap includes a cap unit, a knob and at least one guiding mechanism. The cap unit includes a first cap body formed with a through hole extending along an axis, a second cap body, and a resilient gasket sleeved on the second cap body. The knob has a pressing portion abutting against the first cap body, and an insertion portion projecting into the through hole. The guiding mechanism includes an abutting member disposed on one of the second cap body and the insertion portion, and a guiding member having an inclined surface disposed on the other one of the second cap body and the insertion portion. Rotation of the knob causes the abutting member to slide on the inclined surface, and moves the second cap body between an opening position and a sealing position.

8 Claims, 5 Drawing Sheets

SEALING CAP

CROSS-REFERENCE TO RELATED APPLICATION

This application claims priority of Taiwanese Patent Application No. 104204690, filed on Mar. 27, 2015.

FIELD

The disclosure relates to a sealing cap for sealing an opening of a container.

BACKGROUND

There are various designs for conventional sealing caps in the industry. One common design of conventional sealing caps includes a cap body that is provided with a resilient gasket, and at least one locking mechanism. The cap body is first mounted on a container. Then the locking mechanism is operated to lock the cap body to the container, so that the resilient gasket is resiliently deforced to hermetically seal an opening of the container.

For the conventional sealing cap including one locking mechanism, e.g., a bail closure, the locking mechanism is generally designed to be operated with the exertion of a relatively great force to tightly lock the cap body to the container, making it a laborious affair to open the sealing cap afterwards. For the conventional sealing cap including a plurality of locking mechanisms, since each locking mechanism is operated independently, it is inconvenient and time-consuming for a user to operate the multiple locking mechanisms.

SUMMARY

Therefore, an object of the disclosure is to provide a sealing cap that can alleviate at least one of the drawbacks associated with the conventional sealing cap.

According to an aspect of the present disclosure, a sealing cap is adapted for being detachably mounted on a container and sealing an opening of the container. The sealing cap includes a cap unit, a knob and at least one guiding mechanism. The cap unit includes a first cap body, a second cap body disposed adjacent to the first cap body, and a resilient gasket sleeved on the second cap body. The first cap body is adapted for being detachably mounted on the container, and is formed with a through hole that extends along an axis. The knob is rotatable about the axis and has a pressing portion and an insertion portion. The pressing portion abuts against one side of the first cap body opposite to the second cap body. The insertion portion projects from the pressing portion into the through bole. The guiding mechanism includes an abutting member that is disposed on one of the second cap body of the cap unit and the insertion portion of the knob, and a guiding member that is disposed on the other one of the second cap body and the insertion portion. The guiding member has an inclined surface that extends spirally about the axis. The abutting member abuts slidably against the inclined surface to engage telescopically the first cap body with the second cap body. Rotation of the knob causes the abutting member to slide on the inclined surface, and moves the second cap body relative to the first cap body between an opening position and a sealing position. When the second cap body is at the opening position, the second cap body is away from the first cap body. When the second cap body is at the sealing position, the second cap body is close to the first cap body, so that the resilient gasket is adapted to be urged to resiliently deform to abut tightly against an inner surface of the container, thereby hermetically sealing the opening of the container.

BRIEF DESCRIPTION OF THE DRAWINGS

Other features and advantages of the present disclosure will become apparent in the following detailed description of the embodiment with reference to the accompanying drawings, of which.

DETAILED DESCRIPTION

Figure 1:
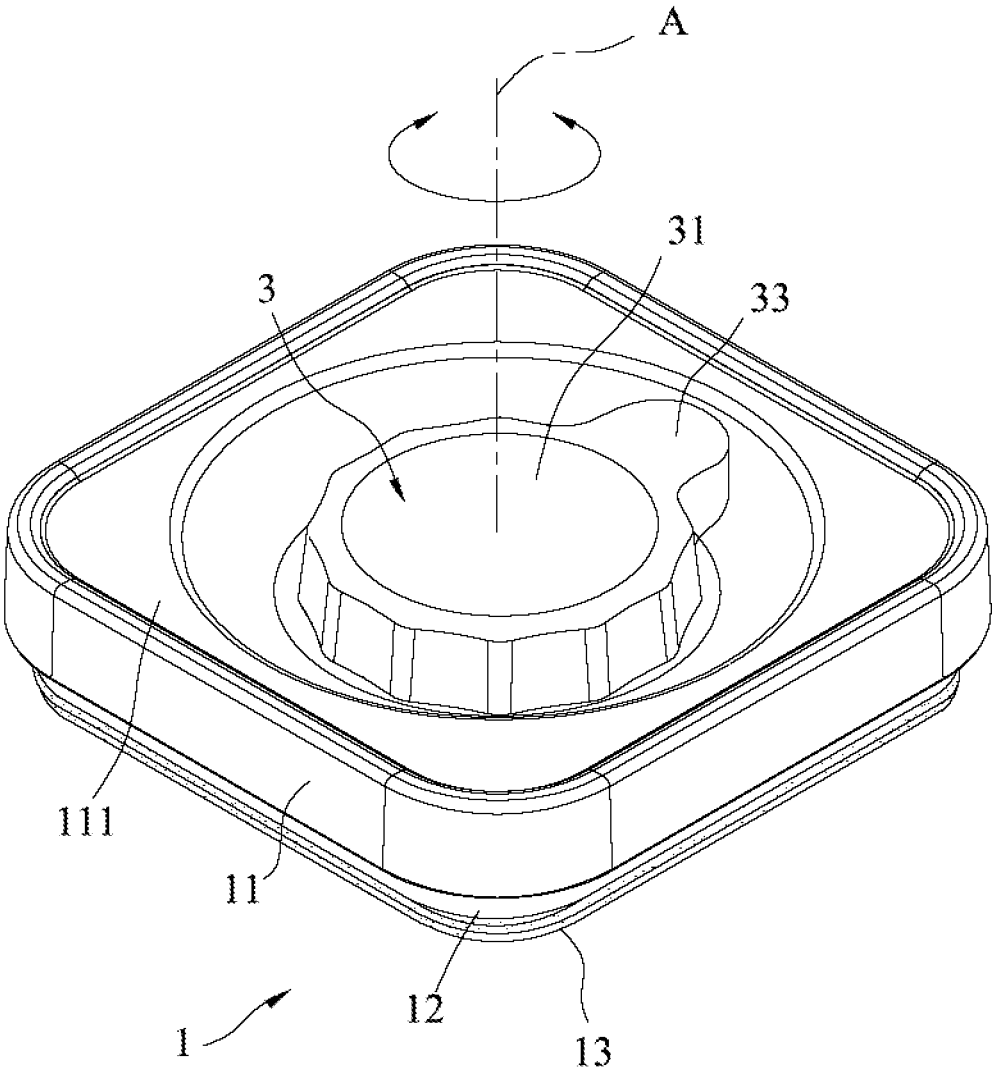
FIG. 1 is a perspective view of an embodiment of a sealing cap according to the present disclosure.
Figure 2:
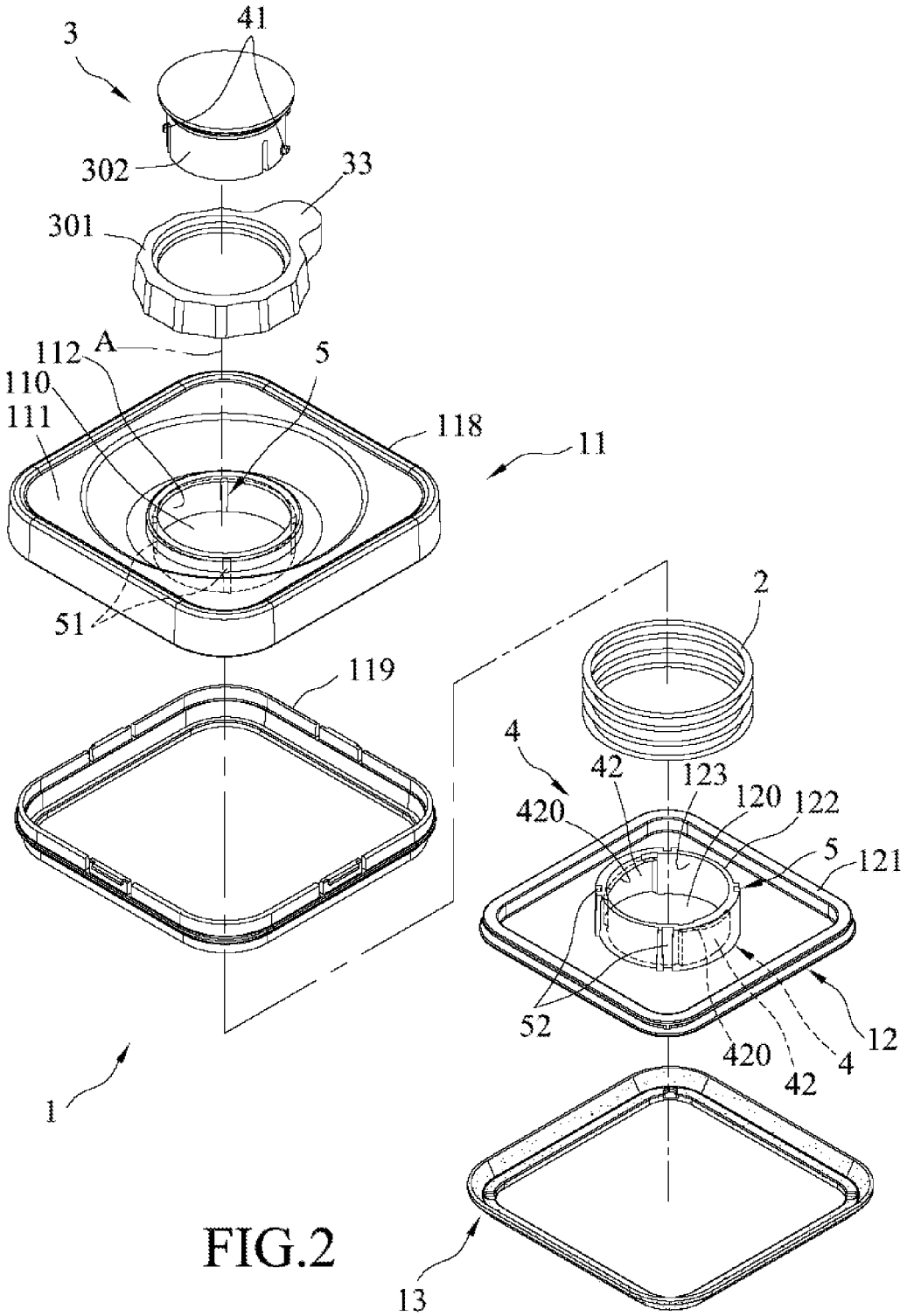
FIG. 2 is an exploded perspective view of the embodiment.
Figure 3:
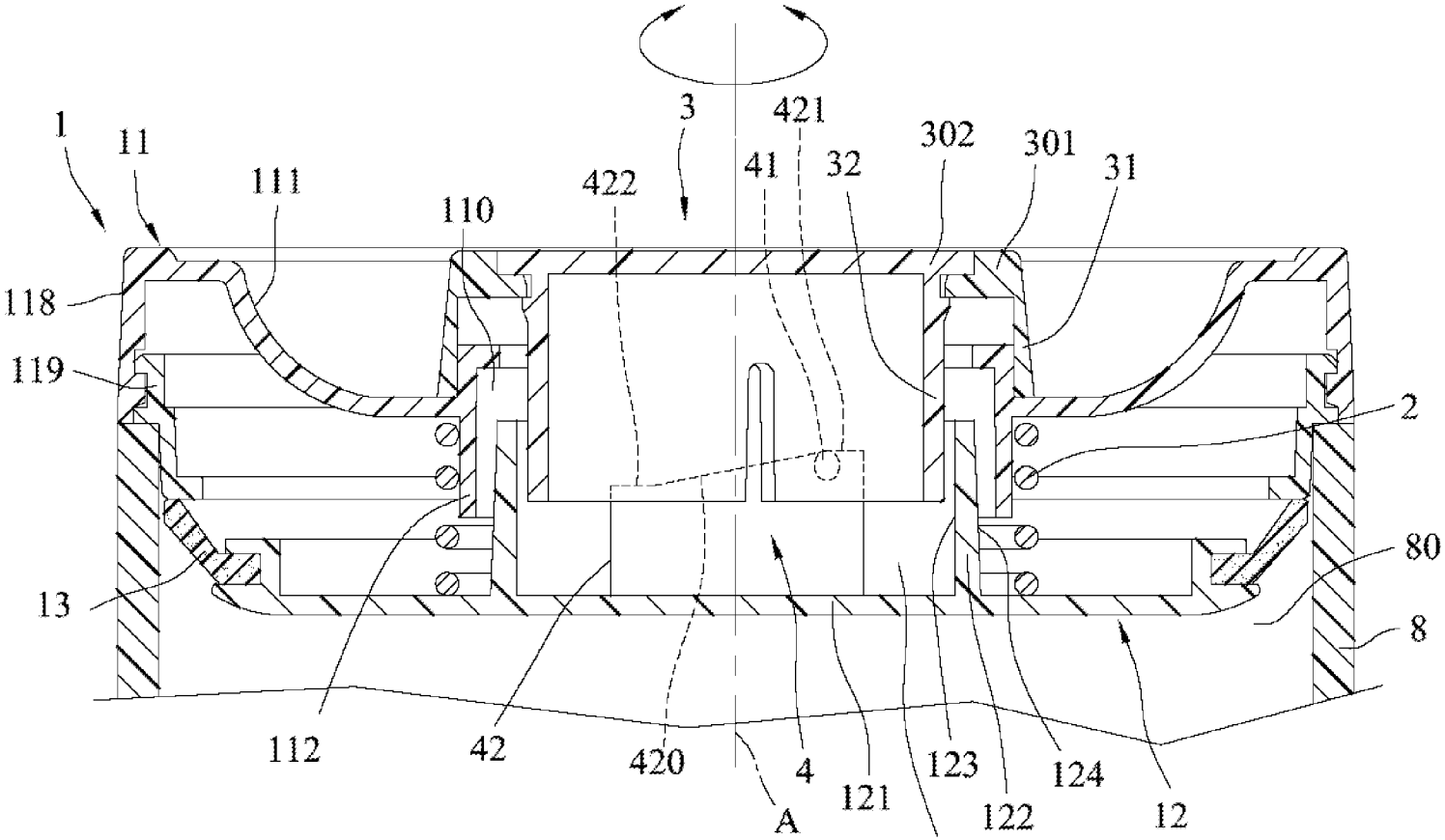
FIG. 3 is a cross-sectional side view of the embodiment showing a second cap body at an opening position.

Referring to FIGS. 1 to 3, an embodiment of a sealing cap according to the present disclosure is adapted for being detachably mounted on a container 8 and sealing an opening 80 of the container 8. In this embodiment, the sealing cap includes a cap unit 1, a resilient member 2, a knob 3, two guiding mechanisms 4 and four limiting mechanisms 5.

The cap unit 1 includes a first cap body 11, a second cap body 12 disposed adjacent to the first cap body 11, and a resilient gasket 13 sleeved on the second cap body 12. The first cap body 11 is adapted for being detachably mounted on the container 8 and includes a first housing member 118 and a second housing member 113 assembled with the first housing member 118. In practice, the number of the housing members may be changed and the housing members may be assembled in different manners according to practical requirements. Moreover, the first cap body 11 may be integrally formed as one piece.

The first cap body 11 as a whole has a base section 111 and a protruding section 112 that projects from the base section 111 along an axis (A) and that defines a through hole 110 extending along the axis (A).

Figure 4:
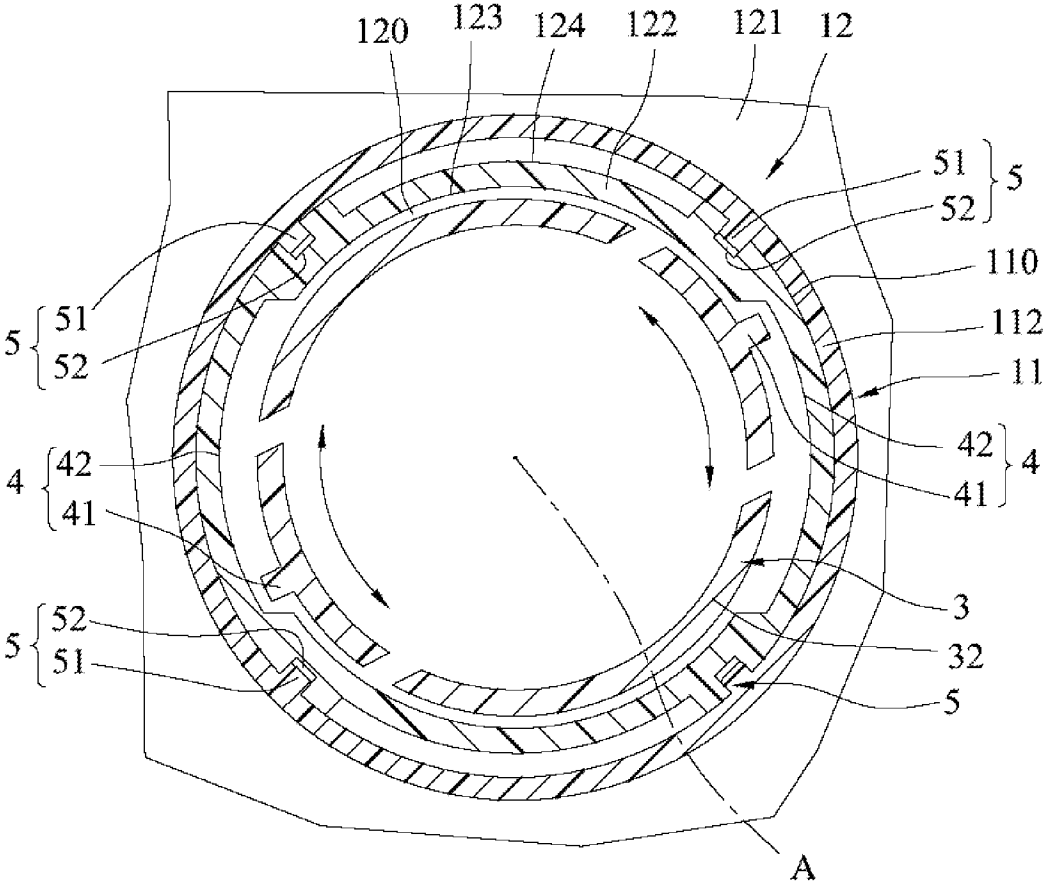
FIG. 4 is a cross-sectional top view of the embodiment.

Referring to FIGS. 2 to 4, the second cap body 12 has a base portion 121 and a protruding portion 122. The base portion 121 is spaced apart from the first cap body 11. The resilient gasket 13 is sleeved on the base portion 121 of the second cap body 12. The protruding portion 122 projects from the base portion 121 along the axis (A) into the protruding section 112 of the first cap body 11 (i.e., extends into the through hole 110 of the first cap body 11). The protruding portion 122 has an inner surface 123 and an outer surface 124 opposite to the inner surface 123. The inner surface 123 surrounds the axis (A) and defines an insertion hole 120.

In this embodiment, the resilient member 2 is configured as a compression spring, and is sleeved on the protruding section 112 of the first cap body 11. The resilient member 2 has opposite ends that abut respectively against the base section 111 of the first cap body 11 and the base portion 121 of the second cap body 12 for biasing the second cap body 12 away from the first cap body 11.

Referring back to FIGS. 1 to 3, the knob 3 is assembled by sleeving a button 302 with a grip 301. In practice, the knob 3 may be integrally ferried. The knob 3 is rotatable about the axis (A) and has a pressing portion 31, an insertion portion 32 and a grip portion 33. The pressing portion 31 abuts against one side of the base section 111 of the first cap body 11 opposite to the base portion 121 of the second cap body 12. The insertion portion 32 projects from the pressing portion 31 into the through hole 110 and the insertion hole 120. The grip portion 33 projects from the pressing portion 31 for facilitating a user to operate the knob 3.

Referring once again to FIGS. 2 to 4, each guiding mechanism 4 includes an abutting member 41 disposed on one of the inner surface 123 of the second cap body 12 of the cap unit 1 and the insertion portion 32 of the knob 3, and a guiding member 42 disposed on the other one of the inner surface 123 and the insertion portion 32. In this embodiment, the abutting member 41 of each of the guiding mechanisms is disposed on the insertion portion 32 of the knob 3 and is configured as a block, and the guiding member 42 of each of the guiding mechanisms 4 is disposed on the inner surface 123 of the second cap body 12. The guiding member 42 has an inclined surface 420 that extends spirally about the axis (A). The inclined surface 420 has a first end 421 and a second end 422 that are respectively proximate to and distal from the first cap body 11. The abutting member 41 abuts slidably against the inclined surface 420 to engage telescopically the first cap body 11 with the second cap body 12.

Each of the limiting mechanisms 5 has a limit groove 52 that extends in the direction of the axis (A), and a limit block 51 that engages slidably the limit groove 52 such that the second cap body 12 is limited to move relative to the first cap body 11 along the axis (A). The limit block 51 of each of the limiting mechanisms 5 is provided to one of the protruding section 112 of the first cap body 11 and the outer surface 124 of the second cap body 12. The limit groove 52 of each of the limiting mechanisms 5 is provided to the other one of the protruding section 112 and the outer surface 124. In this embodiment, the limit block 51 of each of the limiting mechanisms 5 is provided to an inner surface of the protruding section 112, and the limit groove 52 of each of the limiting mechanisms 5 is provided to the outer surface 124.

Figure 5:
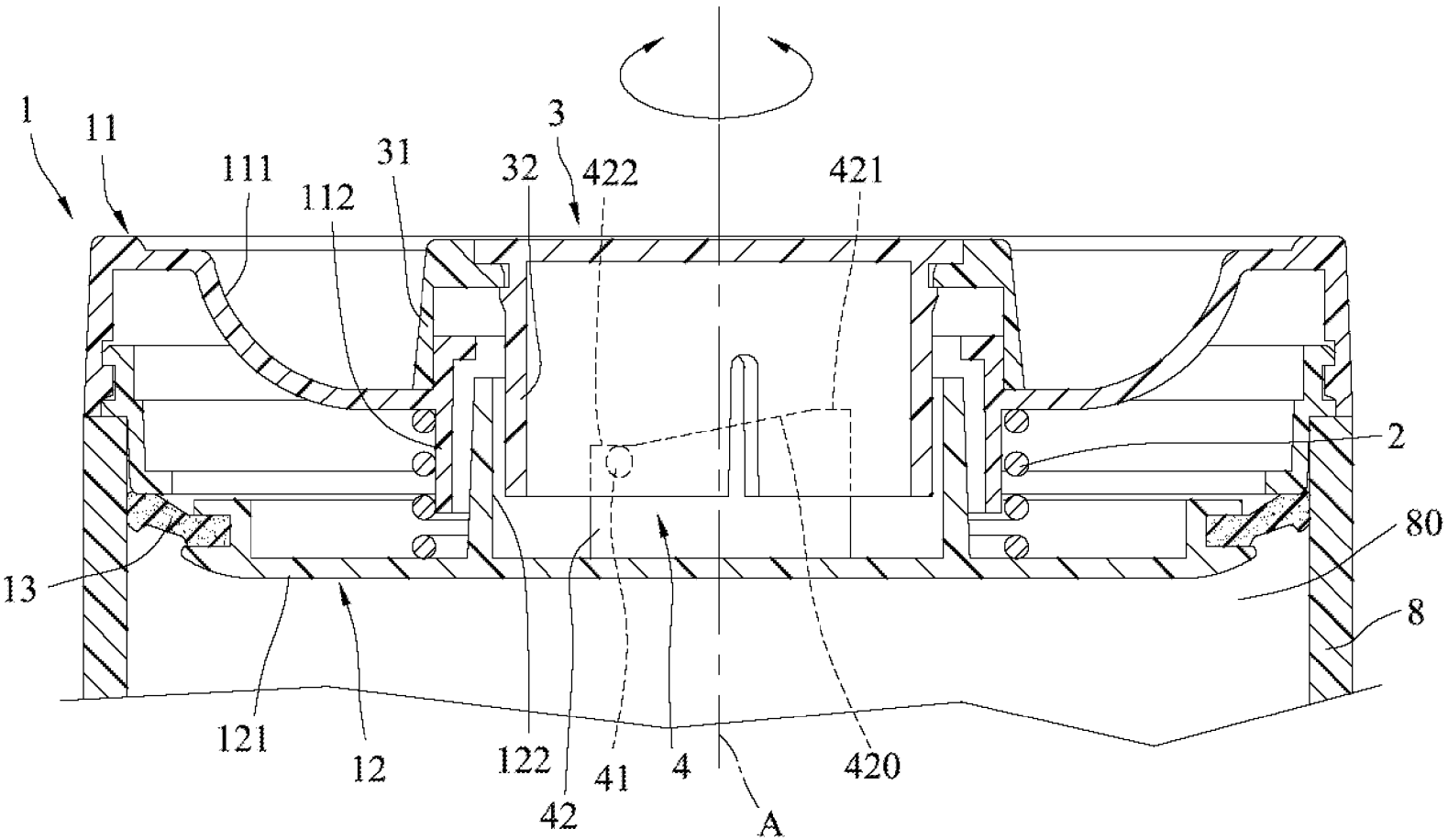
FIG. 5 is a view similar to FIG. 3, but showing the second cap body at a sealing position.

Referring to FIGS. 2, 3 and 5, rotation of the knob 3 causes the abutting members 41 of the guiding mechanisms 4 to slide respectively on the inclined surfaces 420 of the guiding mechanisms 4, and moves the second cap body 12 along the axis (A) relative to the first cap body 11 between an opening position (see FIG. 3) and a sealing position (see FIG. 5). When the second cap body 12 is at the sealing position, the second cap body 12 is close to the first cap body 11 and the abutting members 41 are at the second ends 422 of the inclined surfaces 420, so that the resilient gasket 13 is adapted to be urged to resiliently deform to abut tightly against an inner surface of the container 8, thereby hermitically sealing the opening 80 of the container 8, and so that the resilient member 2 is compressed by the second cap body 12 to store a resilient force. Reverse rotation of the knob 3 causes the abutting members 41 to be moved respectively from the second ends 422 of the inclined surfaces 420 to the first ends 421 of the inclined surfaces 420, thereby moving the second cap body 12 from the sealing position to the opening position. During movement of the second cap body 12 from the sealing positron to the opening position, the resilient member 2 releases the resilient force for pushing the second cap body 12 from the sealing position to the opening position (i.e., for facilitating the movement of the second cap body 12 from the sealing position to the opening position). When the second cap body 12 is at the opening position, the abutting members 41 are at the first ends 421 of the inclined surfaces 420, the second cap body 12 is away from the first cap body 11, and the resilient member 2 is uncompressed.

When in use, the knob 3 of the sealing cap is first rotated by the user such that the abutting members 41 are respectively held at the first ends 421 of the inclined surfaces 420. Then, the sealing cap is placed on the container 8 to cover the opening 80 of the container 8, with the base section 111 of the first cap body 11 abutting against a top portion of the container 8 and the second cap body 12 being received in the container 8.

Next, the knob 3 is rotated by the user until the abutting members 41 are respectively at the second ends 422 of the inclined surfaces 420, thereby moving the second cap body 12 to the sealing position.

When opening the sealing cap, the user reversely rotates the knob 3 until the abutting members 41 are respectively at the first ends 421 of the inclined surfaces 420, thereby restoring the second cap body 12 to the opening position. The resilient member 2 releases the resilient force to facilitate such movement of the second cap body 12. The resilient gasket 13 is restored to an undeformed state and allows the sealing cap to be detached from the container 8.

It should be noted that the number of the guiding mechanisms 4 should not be limited to what is disclosed herein and may be changed according to practical requirements, as long as the abutting member(s) 41 is (are) capable of abutting slidably (and respectively) against the inclined surface(s) 420 for moving the second cap body 12 relative to the first cap body 11 between the opening position and the sealing position. The number of the limiting mechanisms 5 may also be changed according to practical requirements, as long as the second cap body 12 is limited to move relative to the first cap body 11 along the axis (A).

To sum up, by virtue of the guiding mechanisms 4 and the limiting mechanisms 5, rotation of the knob 3 can move the second cap body 12 relative to the first cap body 11 between the opening position and the sealing position. Therefore, it is both labor-saving and time-saving to use the sealing cap for sealing the opening 80 of the container 8.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A sealing cap adapted for being detachably mounted on a container and sealing an opening of the container, said sealing cap comprising:

a cap unit that includes a first cap body adapted for being detachably mounted on the container and formed with a through hole that extends along an axis (A), a second cap body disposed adjacent to said first cap body, and a resilient gasket sleeved on said second cap body;

a knob that is rotatable about the axis (A) and that has a pressing portion abutting against one side of said first cap body opposite to said second cap body, and an insertion portion projecting from said pressing portion into said through hole; and at least one guiding mechanism that includes an abutting member disposed on one of said second cap body of said cap unit and said insertion portion of said knob, and a guiding member disposed on the other one of said second cap body and said insertion portion, said guiding member having an inclined surface that extends spirally about the axis (A), said abutting member abutting slidably against said inclined surface to engage telescopically said first cap body with said second cap body;

wherein rotation of said knob causes said abutting member to slide on said inclined surface, and moves said second cap body relative to said first cap body between an opening position, where said second cap body is away from said first cap body, and a sealing position, where said second cap body is close to said first cap body, so that said resilient gasket is adapted to be urged to resiliently deform to abut tightly against an inner surface of the container, thereby hermetically sealing the opening of the container;

wherein said second cap body has a base portion that is spaced apart from said first cap body, said resilient gasket being sleeved on said base portion of said second cap body, and a protruding portion that projects from said base portion along the axis into said through hole of said first cap body;

wherein said abutting member of said guiding mechanism is disposed on one of said protruding portion of said second cap body and said insertion portion of said knob, said guiding member of said guiding mechanism being disposed on the other one of said protruding portion and said insertion portion; and wherein said sealing cap further comprises a resilient member that has opposite ends abutting respectively against said first and second cap bodies for biasing said second cap body away from said first cap body.

2. The sealing cap as claimed in claim 1, wherein:

said inclined surface of said guiding member has a first end and a second end that are respectively proximate to and distal from said first cap body;

when said second cap body is at the sealing position, said abutting member is at said second end of said inclined surface, and said resilient member is compressed by said second cap body to store a resilient force;

during movement of said second cap body from the sealing position to the opening position, said resilient member releases the resilient force for facilitating movement of said second cap body; and when said second cap body is at the opening position, said abutting member is at said first end of said inclined surface and said resilient member is uncompressed.

3. The sealing cap as claimed in claim 1, wherein said protruding portion of said second cap body has an inner surface that surrounds the axis (A) and that defines an insertion hole, said insertion portion of said knob extending into said through hole of said first cap body and said insertion hole, said abutting member of said guiding mechanism being disposed on one of said inner surface of said second cap body and said insertion portion of said knob, said guiding member of said guiding mechanism being disposed on the other one of said inner surface and said insertion portion.

4. The sealing cap as claimed in claim 3, wherein said first cap body has a base section and a protruding section that projects from said base section along the axis (A) toward said base portion of said second cap body and that defines said through hole, said protruding portion of said second cap body extending into said protruding section of said first cap body.

5. The sealing cap as claimed in claim 4, wherein said protruding portion of said second cap body further has an outer surface opposite to said inner surface, said sealing cap further comprising at least one limiting mechanism that has a limit groove extending in the direction of the axis (A), and a limit block engaging slidably said limit groove such that said second cap body is limited to move relative to said first cap body along the axis (A), said limit block being provided to one of said protruding section of said first cap body and said outer surface of said second cap body, said limit groove being provided to the other one of said protruding section and said outer surface.

6. The sealing cap as claimed in claim 1, further comprising at least one limiting mechanism that includes a limit groove and a limit block that engages slidably said limit groove such that said second cap body is limited to move relative to said first cap body along the axis (A), said limit block being provided to one of said first cap body and said second cap body, said limit groove being provided to the other one of said first cap body and said second cap body.

7. The sealing cap as claimed in claim 6, comprising a plurality of said limiting mechanisms, said limit block of each of said limiting mechanisms being provided to said first cap body, said limit groove of each of said limiting mechanisms being provided to said second cap body.

8. The sealing cap as claimed in claim 1, comprising a plurality of said guiding mechanisms, said abutting member of each of said guiding mechanisms being disposed on said insertion portion of said knob, said guiding member of each of said guiding mechanisms being disposed on said second cap body.

* * * * *